US005423527A

United States Patent [19]

Tranquilla

[11] Patent Number: 5,423,527

[45] Date of Patent: Jun. 13, 1995

[54] DOCUMENT TRANSPORT WITH GAP ADJUST

[75] Inventor: Michael N. Tranquilla, Livonia, Mich.

[73] Assignee: Unisys Corporation, Blue Bell, Pa.

[21] Appl. No.: 147,374

[22] Filed: Nov. 5, 1993

[51] Int. Cl.[6] ..... B65H 5/00

[52] U.S. Cl. ..... 271/10; 271/111; 271/265; 271/259; 271/270

[58] Field of Search ..... 271/110, 111, 265, 270, 271/10, 259

[56] References Cited

U.S. PATENT DOCUMENTS

| | | | |
|---|---|---|---|
| 4,331,328 | 5/1982 | Fasig | 271/111 X |
| 4,451,027 | 5/1984 | Alper | 271/270 X |
| 4,893,804 | 1/1990 | Sasage | 271/111 X |
| 5,121,915 | 6/1992 | Duncan | 271/111 |
| 5,211,387 | 5/1993 | Lloyd | 271/265 X |

FOREIGN PATENT DOCUMENTS

| | | | |
|---|---|---|---|
| 016444 | 10/1992 | WIPO | 271/111 |

*Primary Examiner*—H. Grant Skaggs
*Attorney, Agent, or Firm*—John J. McCormack; Mark T. Starr

[57] ABSTRACT

Disclosed is a method of processing documents by moving them from an input hopper to a destination site at a controlled rate, including driving each document into a feed path from the input hopper at an adjustable time period after a previous document had been fed; then sensing the distance separating that document from a following document, and adjusting the time period between driving of succeeding documents to achieve a desired relationship between the document feed rate and inter-document gap.

5 Claims, 2 Drawing Sheets

DOCUMENT TRANSPORT WITH GAP ADJUST

This invention relates to document processing equipment wherein documents are fed serially along a transport path, and particularly to intermediate means for adjusting inter-document spacing along this path.

BACKGROUND, FEATURES:

Document processing machinery should be designed to yield high speed document transport, yet there are limitations in how fast it can operate. For example, in a check sorter the electromechanical gates which open and close to direct a document into a selected pocket, can only operate so fast—so the interdocument gap becomes important. If the documents are fed too fast, a shortened gap will cause errors such as improper sorting or failure to sort.

And, if one increases document transport speed, this can increase the inter-document gap, but can result in document damage as well as processing and stacker errors.

A further problem is that components involved with the feeding of documents typically rely on mechanical friction, hence the components will wear away and change dimensions; also they are influenced by environmental factors such as temperature and humidity. One way to approach these problems is to choose an operating point which allows for contemplated wear and environmental concerns. While this can be effective, it implies some sacrifice of performance.

Another way to allow for such variable factors is to keep the gap between documents relatively constant. (e.g. see U.S. Pat. Nos. 4,451,027 and 4,331,328.) Typically, document transports are limited in performance by the inertia of the pinch-rolls they must accelerate.—These calling for a lot of power and apt to generate excessive heat. Other limitations and disadvantages of prior art systems are apparent to those skilled in the art of document processor control systems.

Other related art is the following:

U.S. Pat. No. 5,197,726, directed to sheet transportation systems that calculate a target time for sheet arrival at a downstream position and vary the transport speed so that the sheet arrives at the desired time. The sheet feeder has a control unit that receives signals from sheet detectors and controls sheet transport by controlling the speed and time of selected motors; e.g. calculated so that the sheet arrives in time at a registration roller even though it was determined by the sheet feeder.

U.S. Pat. No. 5,094,442 is directed to a sheet positioning system that performs longitudinal and lateral alignment in a sheet path without guides or gates. A sheet is skew-registered by a unit having two drive rolls driven by separate speed control stepper motors. A sheet is aligned laterally by a carriage, which is positioned by a drive system that includes a speed controlled stepper motor and a lead screw. Detectors or sensors supply sheet position signals to a controller for determining appropriate drive signals to the motors for aligning the sheet.

U.S. Pat. No. 5,121,915 is directed to a document processor that has closed loop control of the feed rate, gaps, and input station so that more documents can be processed per minute, even as the mechanism changes because of wear and the environment. A system manager and separator processor card receive input from document sensors and performs a closed loop control of drive motors. The closed loop control includes velocity feedback from the motors to the processor.

U.S. Pat. No. 5,018,716 is directed to an automatic document feeder that adjusts the transportation speed based on the operational state of the transport mechanism. Documents are fed from a roll to a separation unit and then to a feed path. Sensors on the stacker for registration, and a sensor at the discharge point supply signals to a micro-computer for controlling the separation motor, belt motor, and carrier motor. Based on the first document that passes through the system, a learning feature thereafter adjusts the speed of the belt-motor for improved operation.

U.S. Pat. No. 5,186,449 is directed to a sheet feeder unit that calculates the sheet transportation speed to prevent sheet overlap. The sheet transport mechanism feeds copy paper from a unit past sensors, one being activated when the paper hits a feed roller. A control unit analyzes the sensor inputs and selects the appropriate sheet feeder interval.

It is an object hereof to alleviate such problems and provide at least some of the here-described features and advantages. A more particular object is to provide means for increasing spacing between documents in an intermediate section of a document transport. Another object is to correct occasional small spacings that may occur due to improper feeding from a document stack or due to document slip at aligner mechanisms. A more particular object is to provide means for spacing correction, performed by changing transport speed in an intermediate section of the transport, rather than by changing transport speed at the input segment of the transport.

A further object is to avoid conventional solutions such as adjusting speeds of rollers, etc. in the initial length of a transport path because these may necessarily have large inertias because of their specific functions, such as aligning or feeding. These inertias may be impractical or difficult to decelerate and accelerate in order to increase the space between documents.

Yet another object is to provide a document transport system with means for "under-spacing" detection plus associated transport decelerate/accelerate means which are disposed at an "intermediate" transport section, not an initial or terminal sections of the transport path.

SUMMARY OF THE INVENTION

The present invention overcomes the disadvantages and limitations of the prior art document processors, and provides a means to optimize the adjustment of interdocument gap size by intermediate speed-varying means. The invention can correct shorter-than-acceptable gaps by varying the speed of an advance-roll when short gaps (e.g. unacceptable for proper sorting) are detected. The present invention also allows the feed rate of document processor to be set high, for optimum processing, without experiencing jams or other failures under less than ideal conditions. The invention can also compensate for wear of the mechanical elements and for changes in the environmental factors, maintaining desired throughput.

Other objects and advantages of the present invention will be apparent to those skilled in the art.

BRIEF DESCRIPTION OF THE DRAWINGS

The foregoing and other features and advantages of the present invention will be appreciated by workers as they become better understood by reference to the following detailed description of the present preferred embodiments, these being considered in conjunction with the accompanying drawings, wherein like reference symbols denote like elements.

DETAILED DESCRIPTION OF PREFERRED EMBODIMENT

Figure 1:
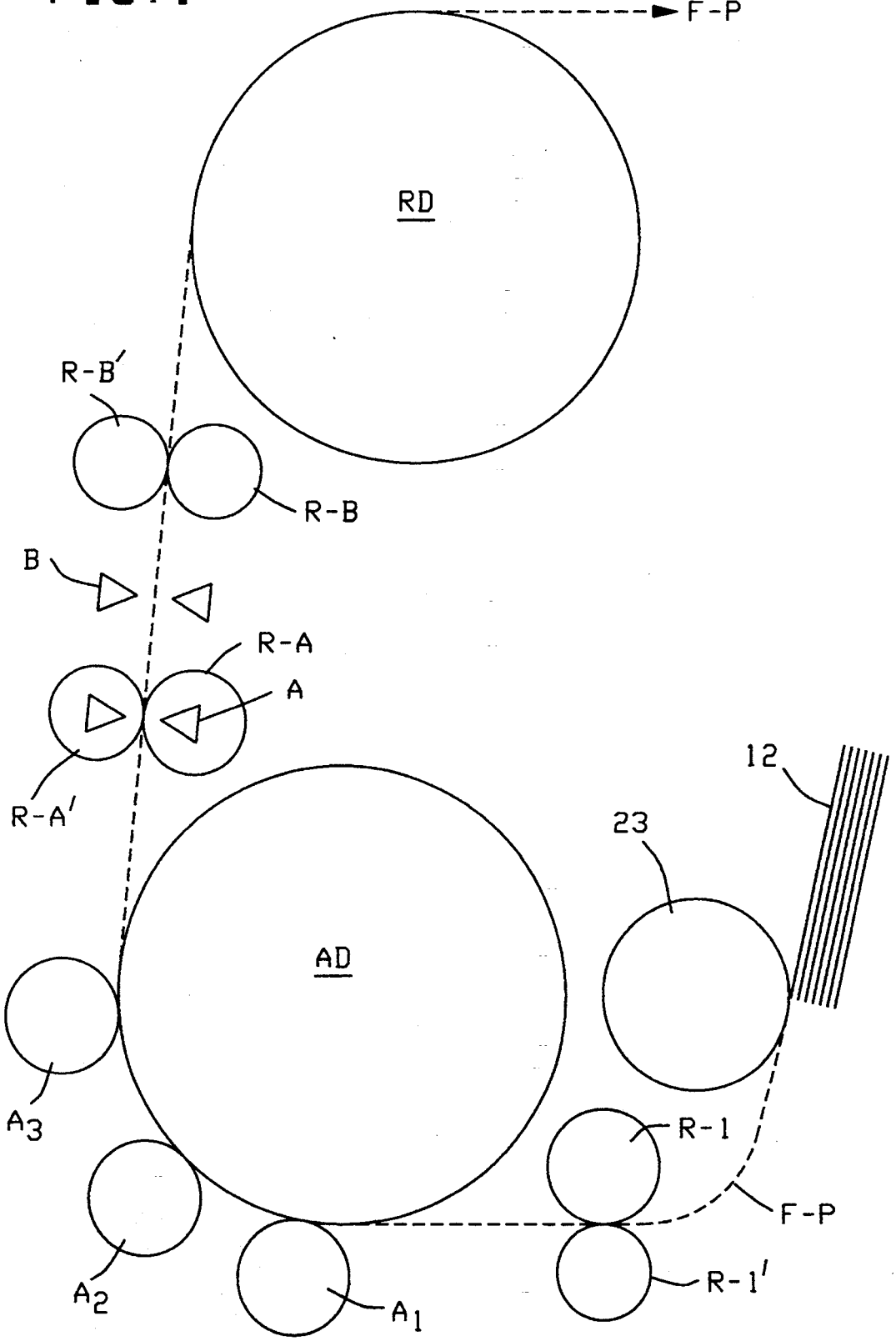
FIG. 1 is a very schematic, idealized showing of a document transport array, including drive rollers apt for use in the invention.

FIG. 1 shows a schematic view of a preferred document transport embodiment according to the present invention. The document transport may be understood to take checks or other documents from a hopper 12 and move them along a feed path, using a picker, or feed wheel 23. Individual checks are carried along the feed path one at a time, past various sensors and readers, some of which will be described later, (e.g. past optional features such as a microfilm camera and an item numbering device) to a plurality of short pockets. The microfilm camera, the item numbering device and the plurality of pockets are not shown but well known. All of these items are generally well known in the art and form only the background against which the present invention is described.

Adjacent hopper 12 is a picker assembly 21 including a feed tire 23, which is operated to advance a single document from the hopper 12 into a nip formed between rolls R-1, R-1'. Feed tire 23 thus serves to initiate each single document along the document feed path f-p, including serial sets of advance-rollers.

Typically, the document is to be transported at constant speed along document path f-p, to be read by magnetic or optical character recognition systems, and/or to be printed on, microfilmed, imaged, routed into other document transports (e.g. sort pockets) via selector gates, and stacked. Any of these actions may require a minimum space between successive documents to function properly, and can be upset by "underspacing". That is, occasionally, the space between two successive documents may fall below the requisite minimum gap $g_m$, creating an "underspace" condition, e.g. because of malfunctions in the feeding or aligning mechanisms. This may be due to poor document quality or condition. This invention detects the underspace after the document has been "picked" (by tire 23) and aligned by the aligner mechanism (AD etc. FIG. 1), and corrects the gap-size before the document reaches other downstream functional mechanisms in the transport.—i.e. gap-size is adjusted by "intermediate" transport means.

The spacing between documents is sensed at edge detector B. The edge detectors may function by any number of conventional electromechanical means which are currently in use. If an underspace is detected between two successive documents, (e.g. D-1, D-2) document transport speed remains constant until the leading edge of the trailing document (here, D-2) reaches motor driven roller R-B. This is accomplished by electrical timing, and is necessary to assure that the trailing edge of this trailing document (D-2) has left the last aligner disk. Then, rollers R-A, R-B may begin to decelerate this next document and so increase the spacing (gap from the preceding document) to the proper size.

The distance between rollers R-A and R-B should generally be less than the minimum document length contemplated; so that, when rollers R-a and R-B are decelerated (when the leading edge of the trailing document reaches R-B the document can be slowed. Rollers R-A and R-B are each driven by independent motors. All other rollers, aligner drums, feed wheels, etc. are maintained at their normal constant speed. At some point, before this leading edge of D-2 reaches the read drum, RD, rollers R-A and R-B are then accelerated to get this document D-2 back up to normal transport speed before reaching the read drum. The process creates increased spacing between documents D-1 and D-2.

However, the document following this trailing document (here, D-3 following D-2) may have already entered roller R-A (its nip) which may be going at a slower speed than the upstream aligner. So, to prevent jamming this document (D-3) at the now-decelerated roller R-A an edge detector, A is located at roller R-A. Then, when the trailing edge of the mentioned trailing document D-2 is sensed by edge detector A, roller R-A no longer controls this document. Electrical signals from edge detector A then cause roller R-A to accelerate back up to normal transport speed before the next document (e.g. D-3) arrives.

In the unlikely event that a succession of several underspaces is created (e.g. by the aligner or feeder), the above-described underspace correction device may not be able to keep up. But logic (computer) controls are provided to count these underspaces, and, in case of two (or N) successive underspaces, to stop the feeder, temporarily, to thereby open up a larger gap between documents.

As an example, for documents like checks about 6 inches long, edge detector A, located at the nip for rollers R-A, R-A', will be about 20 inches along path F-p from feed-wheel 23 and about 4 inches beyond the nip between Align-drum AD and the last aligner-disk $A_3$.

Similarly, Edge-detector B will be 2.5 inches beyond edge-detector A, while Roller R-B (nip with idler R-B') will be about 2.5 inches beyond detector B. [Read drum RD would engage the checks thereafter, then drive them beyond to sorting or other means in the overall processor, as known in the art.]

Figure 3:
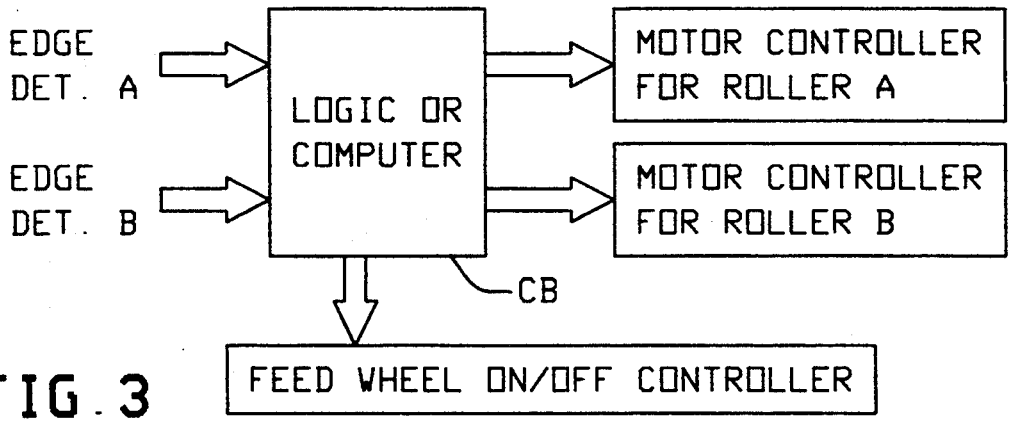
FIG. 3 is a block diagram illustrating a preferred mode of controlling these drive rollers according to an algorithm for actuating drive-motor controllers (e.g. via a computer or hard-wired logic).

FIG. 3 is a block diagram of (salient portions of) the preferred control system for this embodiment, whereby both edge-detectors provide input signals to a computer control block CB (or like logic, as known in the art), to control the speed of (the motors for) drive rollers R-A and R-B, as well as to shut-down feed-wheel 23, if necessary. This control block may be a special purpose hardware controller built with conventional logic and sequencing means, (as known in the art), or it may be a microprocessor with a set of stored programs for executing the foregoing.

As workers know, control block CB may readily be arranged to issue velocity commands to the drive-motors (not shown) for rollers R-A, R-B and associated servos, which may be adapted to provide velocity-feedback to better regulate motor/roller rotational velocity (check acceleration, velocity) and thus better respond to the velocity commands issued from CB.

Figure 2:
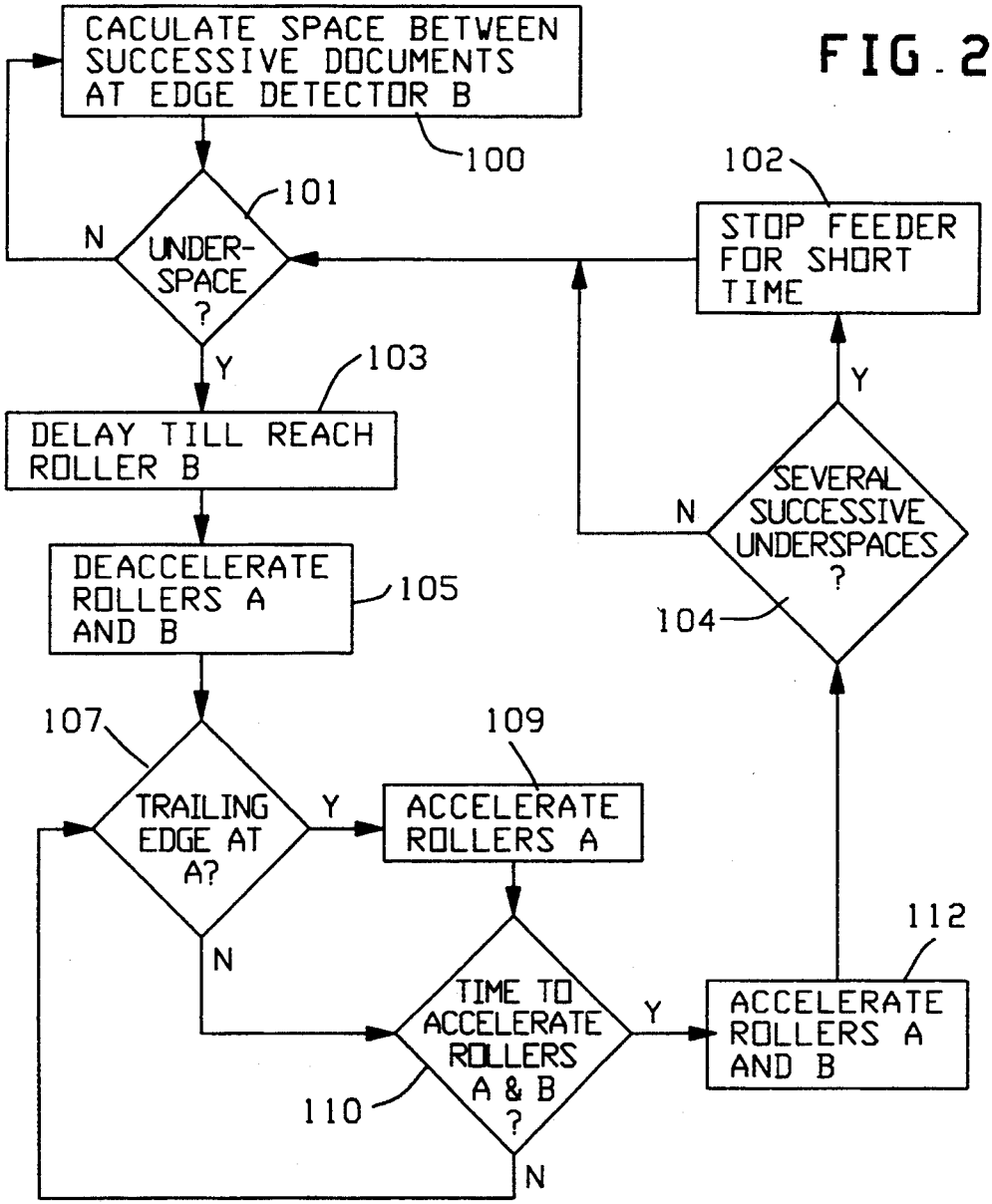
FIG. 2 illustrates salient control functions, in a logic flow diagram illustrating an embodiment of the invention.

FIG. 2 illustrates preferred logic (steps) for so controlling rollers A, B and resultant document velocity—e.g. in terms of what edge-detectors A, B reveal about inter-document gap size. FIG. 2 provides a logic flow diagram which is largely self-explanatory. In keeping with conventional flow diagram techniques, where a question (or test) exists in a block, (such as block 107), if the answer is "Yes", (Y) control follows the branch with the "Y" (in this case to block 109) and if the answer is "No" (N), then control follows the branch with the 'N" (in this case to block 110).

FIG. 2 controls the document advance speeds and thus allows changing gap-size between documents, by sensing gapsize (at detector B). It is assumed that the documents are being moved past sensor B at a fixed speed of approximately 300 inches per second. Thus, in FIG. 2, when detector B detects an inter-check gap shorter than a prescribed length ("underspace"; e.g. less than 2 inc. for a nominal 6 in. check length), (CB, FIG. 3) will process this data and signal "underspace" to logic block 101.

Here, assume an "initial" document D-1 has been advanced along path f-p until its trailing-edge TE passes detector B. Thereupon, timing means measure the "gap-time" $t_g$ until the leading-edge of the next document D-2 passes detector B. The control (computer) translates this time $t_g$ into gap-size.

Whenever a trailing-edge is detected, block 101 will be queried (by computer program, under cycle-clock?) and, if no underspace is found ("N" or "NO"), then simply end the cycle (loop back to START). If YES (Y, indicating "underspace" detected), then block 103 will be triggered to initiate a delay (e.g. 0.008 seconds here) until leading-edge of D-2 can reach roller B; thereupon block 105 will be triggered to cause rollers A and B to decelerate conjunctively (e.g. from a nominal 300 in./-sec. to some lesser speed, depending on size of gap-correction) to slow the document, sufficient to at least open-up the minimum gap size.

Then, when the next trailing edge is detected at detector A [here, of document D-2, meaning that Roller A has now lost control of D-2 and can now be accelerated back to "normal velocity"; servo will check this, e.g. via feedback loop), a YES signal will issue to block 109, so that the next "following" check (e.g. D-3, here) can be advanced at normal speed. Thereafter, (e.g. suitable delay to allow subject check D-2 to clear past roller B—the computer can determine this time according to check-length, distance from roller A to roller B, and current check velocity; as workers know), roller B may likewise be accelerated back to normal velocity via block 110 [YES therefrom, to block 112]—in the absence of this (NO, from block 110), the program loops back to block 107 and proceeds as before-indicated.

—gap detection: (Summary of FIG. 2 operation):

Edge Detector B may be spaced (adjustably) downstream from edge detector A by virtually any convenient distance, to minimum inter-document gap distance $g_m$. Only one edge detector, B in this case, is needed to measure the gap between documents. The edge detector, usually photoelectric, can detect whether a leading edge or trailing edge passes it by electronic logic, or by a computer sensing whether the voltage from the detector falls or rises. Usually this voltage falls or rises very rapidly, so there is no appreciable document movement during these changes. Assuming the documents pass the detector at constant speed, the logic can determine the gap by measuring the time between a falling and rising voltage using an electronic clock, as workers know.

Edge detector A is used only to detect the trailing edge of the D-2 document. Detector B will give the interdocument spacing. (FIG. 2)

Thus, when a given document D-1 has been advanced through this transport path and is about to pass the nip of roller B, its trailing edge will have passed beyond detector A (and the nip of roller A). Hence, entry of the next following document D-2 will soon present its leading-edge LE at detector A—at that time detector A will initiate a query of detector B: "Has trailing-edge (TE of prior document D-1) passed yet?" If the answer is:

"YES"—the gap exceeds $g_m$ so no action is called-for (may be too large?);

"NO"—we have an "underspace" condition (less than $g_m$) and will invoke "DECEL MODE"

Put simply, this (see FIG. 2, blocks 100, 101, 103, 105) causes D-2 to be decelerated (by slowing-down rollers A, B) a suitable amount/time, until the proper gap (e.g. $g_m$) is reestablished from D-1 to D-2. This means that the computer determines how long ($T_D$), it will take for LE of D-2 to engage roller B—after delay $T_D$, both rollers A, B are conjunctively decelerated to slow D-2 enough to open up $g_m$.

Next, when TE of D-2 passes Detector A (FIG. 2, 107), D-2 is thereupon released, to be exit-driven by roller B alone, (still at SLOW speed), so roller A may be returned to (accelerated to) normal speed (block 109), and be ready to advance the next document, (D-3) normally. Then, after a further delay $t_A$, until LE of D-2 enters read drum roller B may likewise be returned to normal speed (blocks 110, 112).

—Successive "under-gaps";

As an additional feature, we prefer to also detect instances of "successive underspaces" (e.g. with known counting means—) and use this to stop feeding checks for a time (enough to be sure that feed-path F-p is clear; and signal this condition, e.g. to an attending operator of the document processor). e.g. as indicated at block 104 and 102.

The foregoing may be otherwise stated as follows in TABLE I.

TABLE I

POST ALIGNER SPACING CORRECTION SERVO

1. Measure spacing when 2nd document's leading-edge (e.g. LE of D-2) crosses BOL B [in FIG. 1].

2. Delay command to change spacing until 2nd document's LE reaches first read station roller (roller B) so that TE of D-2 has exited nip between $A_3$, AD.

3. Then, decelerate both rollers A, B (the first read station roller and the post aligner roller) to correct the spacing.

4. However, when the 2nd document's TE (trailing edge of D-2) reaches the post-aligner roller (A), immediately accelerate roller A. back up to normal transport speed before the LE of the next document (e.g. LE of D-3) reaches roller A.

The system employed can accurately adjust to the desired rate regardless of the length of documents being fed; that is, a feed rate and gap can be specified for nominal-length document and the system can be adjusted for different-length documents—i.e. even without any nominal-length documents being present.

Results:

It will be apparent that any aforedescribed invention is apt for effecting the objects mentioned; e.g. to adjust interdocument gaps with variable-speed transport means disposed intermediate the input (feed-end) and output (use-stations) of a transport path; e.g. to correct occasional small gap variations that may occur due to improper feed-in or from document slip at initial upstream mechanisms, such as an aligner.

It will be evident that this spacing correction is performed by automatically changing transport speed at an "intermediate" transport segment, rather than by changing transport speed for an initial (input) segment. Workers will recognize that since rollers, etc. in the initial transport segment often necessarily have large inertias (e.g. because of their specific functions, such as aligning or feeding), these inertias make it impractical, or difficult, to decelerate documents therewith by way of correcting (increasing) document-spacing. Accordingly, this is better done with an "intermediate" transport segment, as here described.

Of course, many modifications to the preferred embodiment described previously are possible without departing from the spirit of the present invention. For example, there are many different ways to provide controls as described in the present invention, and it is not limited to the particular types of sensors or the particular types of advance means. As a further example, the feedback control in its preferred embodiment is described as a software algorithm, but it is well known that the same functions can be accomplished using known hardware. Additionally, some features of the present invention can be used to advantage without the corresponding use of other features.

Accordingly, the description of the preferred embodiment should be to be considered as including all possible modifications and variations coming within the scope of the invention as defined by the appended claims.

What is claimed is:

1. In a method of processing documents by moving the documents from an input hopper along a path to a destination site at a controlled rate, and enroute, correcting inter document gaps to conform to a set, adjustable gap size, the steps comprising:

feeding the documents with picker means along a feed path from the input hopper along said path; providing advance means along said path intermediate said picker means and said destination site; providing intermediate document sensor means along said feed path from the input hopper; controllably advancing the document and likewise so driving a following document, with said advance means;

sensing the distance between a given document and the following document, and adjusting said advance means to accelerate/decelerate the given document to tend toward said set gap size.

2. A method including the steps of claim 1, wherein the step of adjusting said advance means includes storing a value representing the instantaneous duty cycle and gap size; and comparing the stored duty cycle and gap size with stored "nominal" values representative thereof; and adjusting the adjustable drive speed of said advance-means to so tend toward said nominal gap size.

3. The method of claim 2, wherein a minimum interdocument gap $G_m$ is prescribed, and, when a gap greater than $G_m$ is automatically detected, then causing the given document to be accelerated sufficient to tend to reestablish $G_m$.

4. The method of claim 2, wherein a minimum interdocument gap $G_m$ is prescribed, and, when a gap less than $G_m$ is detected, decelerating the following document sufficient to tend to reestablish $G_m$.

5. The method of claim 4, including the step of providing means to detect and register a "repeated undergap" condition for N successive documents and to responsively automatically stop the operation of said picker means for a suitable delay time.

* * * * *